United States Patent [19]

Nelson et al.

[11] 4,197,811

[45] Apr. 15, 1980

[54] TONER APPLICATOR AND REMOVAL APPARATUS

[75] Inventors: Alfred M. Nelson, Redondo Beach; David L. Davis, Venice, both of Calif.

[73] Assignee: AM International, Inc., Los Angeles, Calif.

[21] Appl. No.: 873,178

[22] Filed: Jan. 30, 1978

Related U.S. Application Data

[62] Division of Ser. No. 726,912, Sep. 27, 1976, abandoned.

[51] Int. Cl.[2] ..... B05C 3/12; B05C 3/18; B05C 11/06; B05C 11/10

[52] U.S. Cl. ..... 118/50; 118/63; 118/123; 118/653; 15/306 A

[58] Field of Search ..... 15/306 A, 308; 118/50, 118/63, 123, 652

[56] References Cited

U.S. PATENT DOCUMENTS

| | | | |
|---|---|---|---|
| 2,442,350 | 6/1948 | Felber | 118/63 X |
| 3,260,577 | 7/1966 | Mayhew | 118/123 X |
| 3,370,982 | 2/1968 | Hayunga | 15/308 X |
| 3,438,706 | 4/1969 | Tanaka et al. | 15/308 X |
| 3,526,204 | 9/1970 | Schnedler et al. | 118/63 |
| 3,546,733 | 12/1970 | Johnson | 15/308 |
| 3,620,230 | 11/1971 | Foret | 15/308 X |
| 3,686,035 | 8/1972 | Riley, Jr. | 15/308 X |
| 3,882,568 | 5/1975 | Hill | 15/308 |

OTHER PUBLICATIONS

IBM Technical Disclosure Bulletin, vol. 9, No. 6, Nov. 1966.

*Primary Examiner*—Wm. Carter Reynolds
*Attorney, Agent, or Firm*—Robert S. Hulse

[57] ABSTRACT

Apparatus for applying toner to a tape which has toner-attracting images thereon, including a chamber containing toner, a chamber inlet located below the top of the toner, a chamber outlet above the top of the toner, and a tape guide which is convex along the tape path which leads through the toner to minimize toner pickup on the rear face of the tape. A vacuum is maintained at the top of the chamber to create an inflow of air at the tape outlet, to sweep back loose toner.

3 Claims, 7 Drawing Figures

Fig. 4
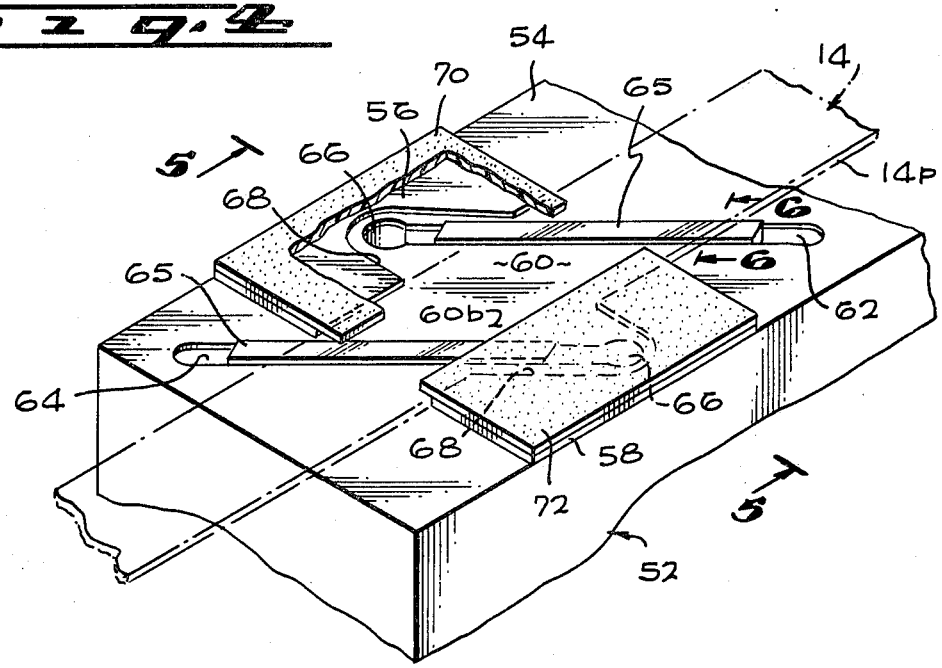
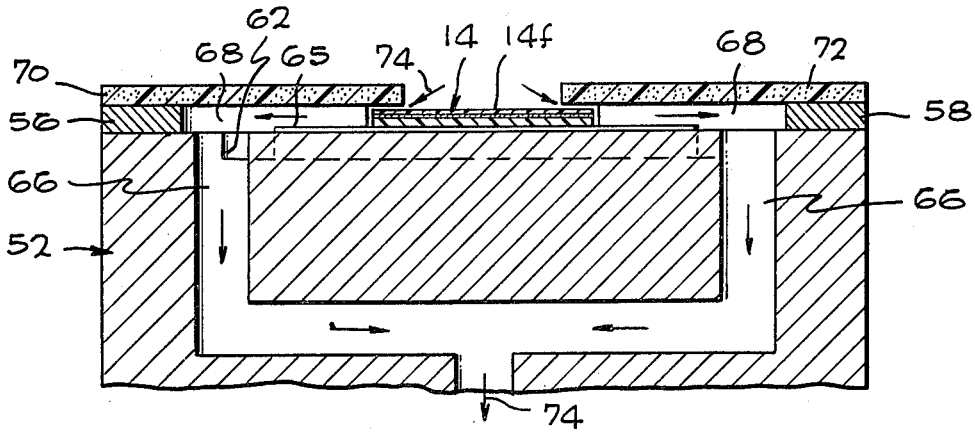
Fig. 5
Fig. 6
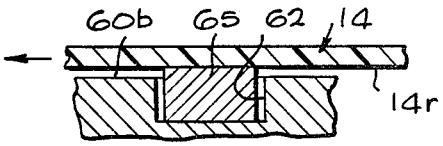
Fig. 7
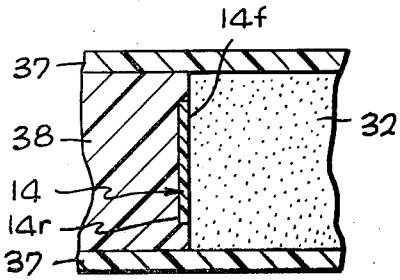

TONER APPLICATOR AND REMOVAL APPARATUS

REFERENCE TO RELATED APPLICATION

This is a division of application Ser. No. 726,912 filed Sept. 27, 1976, now abandoned.

BACKGROUND OF THE INVENTION

One printing system, described in U.S. Pat. Application Ser. No. 631,329, filed Nov. 12, 1975 by Alfred M. Nelson, now abondoned, includes a recording head for recording magnetic images on the front face of a magnetic tape, a toner-applying apparatus for applying toner to the images, and a transfer station which transfers the toner to paper to form an image on the paper corresponding to the characters formed on the tape. An important problem that arises with such a system is that the background area of the paper (the area around the printed characters) tends to become dirty with stray toner particles. Also the tape transport apparatus tends to become fouled with stray toner particles. Thus, a toner applying apparatus would be especially useful, if it could apply toner particles substantially only to the desired image areas of a tape or other record medium, while avoiding the application of toner to other areas thereof.

SUMMARY OF THE INVENTION

In accordance with one embodiment of the present invention, apparatus is provided for applying toner to toner-attracting images on a tape or other record medium, which minimizes toner application to areas of the record other than those forming the images. The toner applying apparatus includes a chamber holding toner and having inlet and outlet openings for receiving and passing out a tape record. A guide is provided that supports the rear face of the tape all along the region where the tape passes through toner. The guide is convex all along the region which lies in toner, so that tension in the tape tends to hold it firmly against the guide to minimize toner application to the rear face of the tape.

The inlet of the chamber lies below the top of the toner level, to simplify guiding of the tape along a convex guide through the toner. A brush is provided at the inlet, with the bristle ends extending parallel to the tape path, to seal the opening against the loss of toner therefrom and to add tension to the tape. The tape outlet lies at a region devoid of toner, such as above the toner level. A vacuum is applied to the chamber region above the toner, to produce an airflow into the chamber through the outlet, that tends to sweep loose toner back into the chamber. A tape guide is also provided which has a tape-guiding channel with grooves therein that are attached to a vacuum source, to further clean off the toner. Scraper elements also lie in the groove to help scrape off toner. The channel has cutaway sides and has resilient covers extending slightly over each side of the tape path, to help remove toner along each edge of the front face of the tape.

The novel features of the invention are set forth with particularity in the appended claims. The invention will be best understood from the following description when read in conjunction with the accompanying drawings.

BRIEF DESCRIPTION OF DRAWINGS

FIG. 4 is a perspective view of a portion of the apparatus of FIG. 2;

FIG. 5 is a view taken on the line 5—5 of FIG. 4;

FIG. 6 is a view taken on the line 6—6 of FIG. 4; and

FIG. 7 is a view taken on the line 7—7 of FIG. 3.

DESCRIPTION OF PREFERRED EMBODIMENTS

Figure 1:
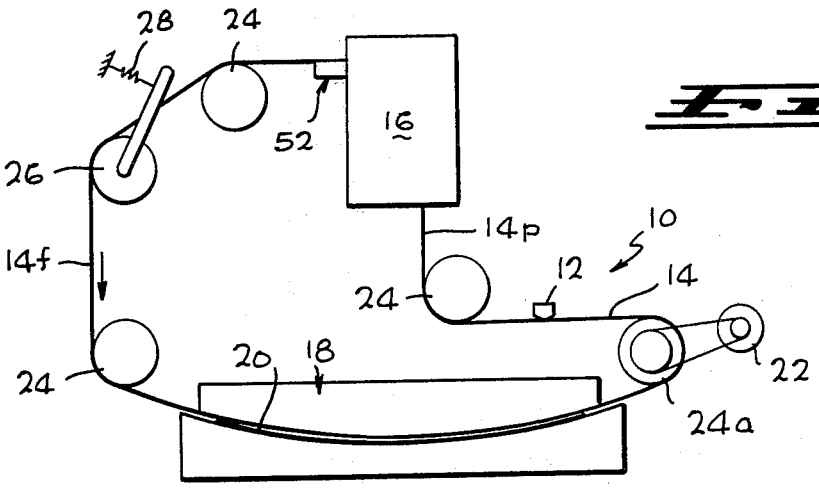
FIG. 1 is a simplified side elevation view of a printer apparatus constructed in accordance with the invention.

FIG. 1 illustrates a printing system 10 which includes a recording head 12 that records magnetic images on a magnetic tape record 14. The tape moves along a tape path **14*p* that extends through a toner applying apparatus 16, where toner is applied to the magnetic images recorded on the tape, and through a transfer station 18, where toner is transferred from a front face 14*f* of the tape to a sheet or strip of paper 20. After each group of perhaps 100 characters is recorded by the head 12 on the tape and the images are coated with toner, the group of toned images is transferred at the station 18 to the paper 20 to form a line of characters thereon. The paper 20 is then advanced (in a direction into the paper as seen in FIG. 1) so that a new line of characters can be printed thereon. The tape 14 extends in an endless loop, is driven thereabout by a motor 22 coupled to a roller 24*a*, is guided thereabout by several other rollers 24, and is maintained under tension by a tensioning roller 26 which is biased by a spring 28**.

Figure 2:
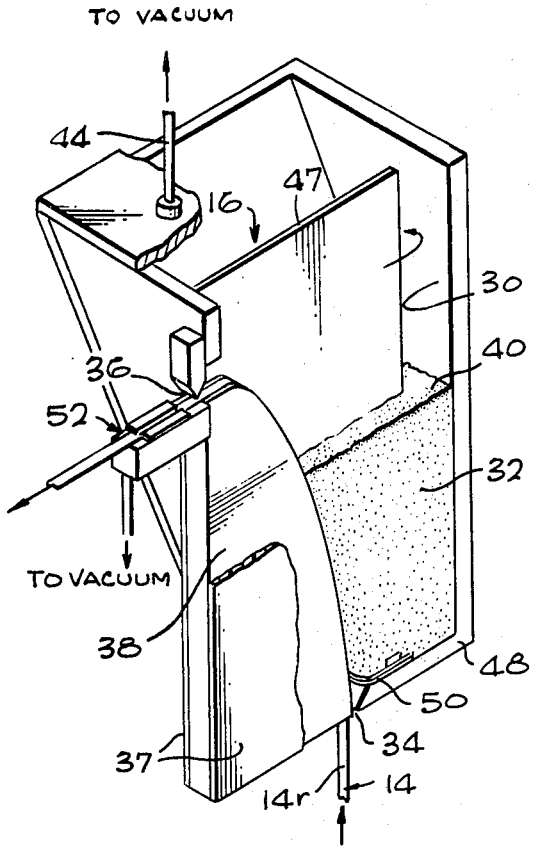
FIG. 2 is a perspective view of the toner applying apparatus of the system of FIG. 1, with a wall thereof cut-away.

FIG. 2 illustrates the toner applying apparatus 16, which includes walls forming a chamber 30 that holds a quantity of magnetically-attractable toner 32 for application to image areas on the tape 14. The chamber has an inlet 34 where tape enters the chamber, and has an outlet 36 where the tape exits therefrom. A wall 38 of the chamber serves as a tape guide which guides the tape in movement between the inlet 34 and the outlet 36. The chamber is thin, and has side walls, one of which 37 is shown cutaway to aid in illustrating the apparatus.

Figure 3:
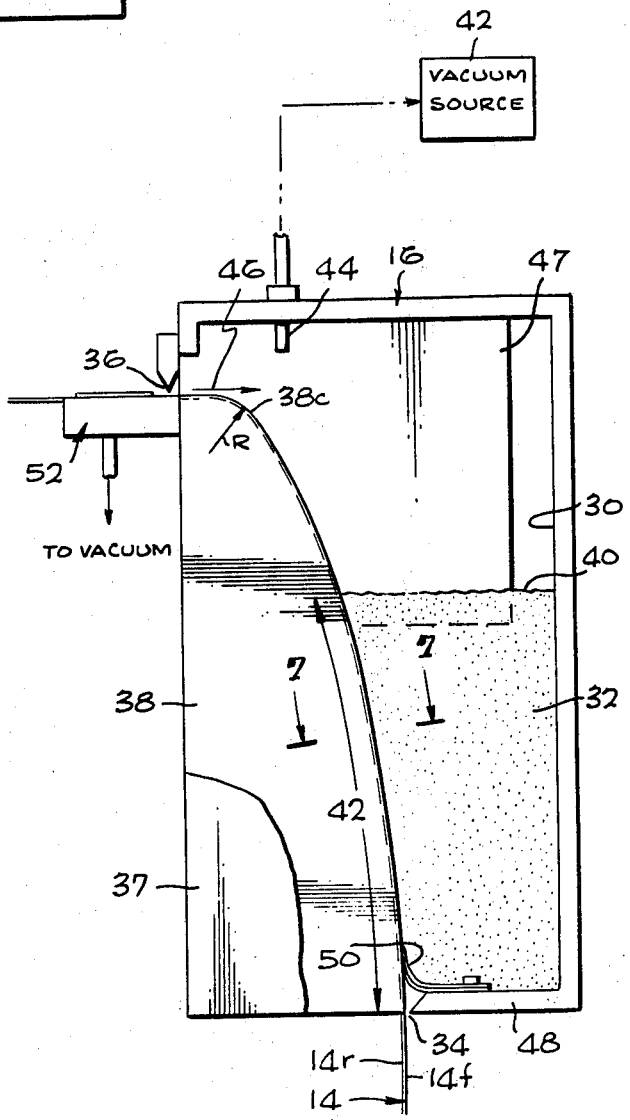
FIG. 3 is a side elevation view of the toner applying apparatus of FIG. 2, with a wall thereof removed.

It can be seen (FIG. 3) that the inlet 34 lies below the level 40 of the toner (the level varies as toner is added or used up) while the outlet 36 lies above it. This allows the tape guide 38 to extend in a convex curve along the region 42 where the guide extends within the toner. The fact that the tape is under tension and the guide 38 is convexly curved, results in the rear face **14*r* of the tape not being exposed to the toner 32, so that pickup of toner thereat is minimized. The front face 14*f* of the tape is the one exposed to the toner so that the magnetic images attract toner thereto. In spite of these precautions, some toner will still adhere to the rear face of the tape, and the toner applying apparatus is constructed with devices for removing such toner. The apparatus also includes devices for removing excess toner on the front face 14*f*** of the tape.

In order to help remove excess toner at the front face **14*f* of the tape, the tape guide 38 is provided with a relatively sharp curve at 38*c*, where the guide extends about a small radius of curvature R such as one inch, which is smaller than the radius of curvature at the region 42** which is immersed in toner. At a rapid tape speed such as fifty inches per second and a small radius of curvature R, such as one inch, toner on the tape is subjected to an appreciable centrifugal force, due to its angular acceleration of 6.5 g (6.5 times the acceleration of gravity), which tends to throw off excess toner from the front face of the tape. A radius of curvature R of less than two inches and a tape speed of more than twenty inches per second is sufficient to create an angular acceleration of one-third g and thus a centrifugal force which appreciably aids in removing excess toner.

Excess toner on the front face 14*f* of the tape is also removed by the use of a vacuum pump 42 which is connected to a coupling 44 at the upper portion of the chamber. The vacuum pump maintains a vacuum in the chamber region which lies above the toner. The vacuum creates an inflow of air through the outlet 36, as indicated by arrow 46. This current of air tends to sweep excess toner particles back into the chamber. It is desirable that outlet 36 be a narrow slit so that, although there is a relatively high velocity of air passing therethrough, there is only a small volumetric flow of air compared to the volume of air in the chamber 30. This results in the air stream rapidly slowing, so that toner swept back with the air can fall into the bed of toner resting in the chamber, instead of being drawn out through the vacuum coupling 44. A baffle 47 helps to slow the air flow, and the airholding portion of the chamber 30 is enlarged to provide a large volume that further slows air movement towards the vacuum coupling.

The locating of the tape inlet 34 below the top of the toner, and especially in the bottom wall 48 of the chamber, could result in considerable spillage of toner through the tape inlet. To avoid this, a brush 50 is provided at the inlet to form a seal that presses against the tape 14 while allowing the tape to easily pass into the chamber. The brush 50 includes numerous resilient bristles, with one end coupled to the chamber wall and the other end portions biased against the tape and extending down-path along the path of the tape. The brush serves not only to seal the inlet, but also tends to slightly retard the tape to help assure tension in the tape portion which extends through the toner apparatus.

The toner applying apparatus 16 includes a tape cleaning device 52 located down path of the chamber outlet 36, to further clean the tape. As best shown in FIG. 4, the device includes a base 54 and a pair of guide members 56, 58 on either side of the tape path 14*p*, to form a tape-holding channel region or channel 60. The pair of grooves 62, 64 extend across the channel, with the bottom of each groove such as 62 lying below the bottom wall 60*b* of the channel, as best shown in FIG. 6. A scraper member 65 lies within each groove and is slightly thicker than the groove to extend slightly above the bottom of the adjacent portions of the channel. The scraper 65 tends to scrape excess toner from the rear face 14*r* of the tape. As shown in FIG. 4, a vacuum conduit 66 is coupled to one end of each groove 62 to draw away excess toner. The end of each groove opposite the vacuum conduit, is open to the atmosphere, to provide a flow of air across the width of the tape.

Each guide member such as 56 (FIG. 4) includes a cutaway region 68, that form cutaway side walls of the channel 60. This allows the vacuum from conduits 66, to be applied to the grooves 62, 64. In addition, a resilient cover member 70, 72 lies over each guide member 56, 58 to seal the cutaway areas 68 and to help in removal of excess toner. As shown in FIG. 5, each guide member 56, 58 has a thickness approximately equal to that of the tape 14, and each resilient cover member 70, 72 extends over a side portion of the tape path at a level approximately equal to the top, or front face 14*f*, of the tape. Images on the front face 14*f* of the tape lie only in the middle portion of the front face, but not along the opposite edge portions of the front face. The overlying cover members 70, 72 form narrow pathways for air movement, as indicated by arrows 74, across the edge portions of the front face of the tape, to help carry away toner that may lie thereat. The vacuum conduits 66 may be connected to the same vacuum pump 42 which supplies a vacuum to the toner chamber with appropriate throttling. A vacuum level such as one-half inch water to one inch of water (0.02 to 0.04 psi pressure below ambient) has been found sufficient for application to the chamber, and while a vacuum of 50 inches of water has been found sufficient for application to the tape cleaning device, to clean off excess toner.

Thus, the invention provides a toner applying apparatus which can apply toner to the toner-attracting images on a tape or the like, and which minimizes toner application to non-imaged areas of the tape. Avoidance of toner application to the rear face of the tape is aided by providing a convexly curved tape guide all along the region where the tape passes through the toner, while holding the tape in tension. This is accomplished by providing a tape inlet which lies beneath the level of toner, and by providing a brush which bears against the tape to seal the inlet and to help apply tension to the tape. Removal of excess toner on the front face of the tape is accomplished by providing a small radius of curvature region along the tape path above the toner level, so that toner tends to fly off a rapidly moving tape by reason of centrifugal forces. Also, a vacuum is applied to the upper portion of the toner-holding chamber, to provide an inflow of air from the tape exit, so that air currents tend to sweep excess toner back into the chamber. A tape cleaning device is also provided which includes a groove under the tape path, which is connected to a vacuum to draw off excess toner on the rear face of the tape, and with a scraper lying in the groove to help scrape off excess toner. Also, cover members are provided which overlie the side portions of the tape, so that toner at the edge portions of the front face of the tape tend to be drawn under the cover members to a vacuum.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. In a toner-applying apparatus for applying toner to a tape along a tape path, the tape having a front face and a rear face, a tape cleaning device comprising:

a tape-holding means having a base portion and paired guide members forming a tape-holding channel region therebetween, the base portion forming a bottom wall and the paired guide members forming cutaway side walls, said region extending along a portion of the length of said tape path for guiding said tape, said channel region having the cutaway side walls disposed at a predetermined location to form a widened channel location;

a pair of covers covering the sides of said channel region at said cutaway side walls thereof, each of said covers extending over respective side portions of the front face of said tape; and means for applying a vacuum to the region under said covers, whereby to draw off excess toner particles at opposite sides of the front face of said tape.

2. The device described in claim 1 wherein the tape-holding means includes at least one groove extending across said channel region, with the bottom of the groove disposed below the bottom of adjacent portions of the channel region, and the means for applying a vacuum also applies a vacuum to said groove whereby to draw off excess toner particles.

3. The device described in claim 2 including:

a scraper member lying in said groove and extending slightly above the level of the bottom of adjacent portions of said channel region, whereby to scrape toner from the rear face of the tape.

* * * * *